US005979823A

United States Patent [19]

Schlumpf et al.

[11] Patent Number: 5,979,823

[45] Date of Patent: Nov. 9, 1999

[54] DEVICE FOR CLAMPING A SLEEVE ONTO A ROTATABLE DRIVEN TUBE

[75] Inventors: Hans Peter Schlumpf, Steinhausen; Richard Gyr, Schonenberg; Emil Wymann, Littau, all of Switzerland

[73] Assignee: Schlumpf AG, Steinhausen, Switzerland

[21] Appl. No.: 08/990,429

[22] Filed: Dec. 15, 1997

[30] Foreign Application Priority Data

Mar. 21, 1997 [EP] European Pat. Off. ..... 97104859

[51] Int. Cl.[6] ..... B65H 75/24

[52] U.S. Cl. ..... 242/571.2; 279/2.08

[58] Field of Search ..... 242/571.2, 571.1, 242/576.1; 279/2.07, 2.08

[56] References Cited

U.S. PATENT DOCUMENTS

| | | | |
|---|---|---|---|
| 3,052,420 | 9/1962 | Roberts . | |
| 3,592,405 | 7/1971 | Young | 242/571.2 |
| 3,848,517 | 11/1974 | Hawke . | |
| 4,026,491 | 5/1977 | Bostroem | 242/571.2 |
| 4,147,312 | 4/1979 | Secor et al. . | |
| 5,509,618 | 4/1996 | Kleiman et al. | 242/571.2 |
| 5,518,203 | 5/1996 | Annaka et al. . | |

*Primary Examiner*—John M. Jillions
*Attorney, Agent, or Firm*—Henry M. Feiereisen

[57] ABSTRACT

A device for clamping a sleeve placed onto a tube for winding and/or unwinding a two-dimensional web, which, due to the clamping effect of at least one of the clamping elements to be engaged with the sleeve, is effectively connected with the tube which is rotated and driven around a longitudinal axis. The device has a hollow cylindrical tube, the inside space of which is developed as a pressure chamber to be charged with a medium, while the tube is provided with several clamping elements distributed to one another both in the axial and in the circumferential direction, while the clamping elements each are provided with a pressurized thrust carrying piece which can be moved radially and slid toward the outside to engage the sleeve, which, upon corresponding depressurization, releases the sleeve and returns said thrust carrying piece to the starting position.

10 Claims, 3 Drawing Sheets

DEVICE FOR CLAMPING A SLEEVE ONTO A ROTATABLE DRIVEN TUBE

FIELD OF THE INVENTION

This invention pertains to a device for clamping a sleeve placed onto a tube for winding and/or unwinding a two-dimensional web, which, due to the clamping effect of at least one of the clamping elements to be engaged with said sleeve, is effectively connected with the tube which is rotated and driven around a longitudinal axis.

BACKGROUND OF THE INVENTION

The present invention deals with the problem of winding and/or unwinding two-dimensional web materials onto or from a corresponding sleeve designed for this purpose, for example, webs made from paper, plastic, metal foil or similar material. In this case, it is necessary that the sleeve is slid in the axial direction onto shaft means, for example, either a mandrel or a clamping shaft, and is effectively connected by means of a suitable clamping means in such a way that the sleeve together with the mandrel or the clamping shaft are effectively connected around a common longitudinal axis.

For the purpose of clamping means for winding and/or unwinding a two-dimensional web onto a shaft or the like, clamping devices are generally known. For example, in a first variant at the outer shell of a bracing tube, which is rotatable around the longitudinal axis of said tube, are provided several grooves which are distributed in the circumferential direction and run in the longitudinal direction, said grooves being designed to accommodate hoses. Alternately, in a second variant, a single hose is placed in the axial direction into the inside space of the bracing tube, while the hoses are so changed in their outside diameter as a result of being filled with suitable medium, that the pressure elements, which are connected with the outside hoses or the hose located inside the bracing tube, are pressed radially toward the outside and as a result can be engaged by way of clamping with the inside wall of the sleeve.

Taking into consideration the limited clamping force which can be achieved with these known clamping devices, they have a limited field of application. Also, the designs of the bracing tubes, which are provided with outer grooves or with individual openings for the pressure elements, are relatively costly. Furthermore, hoses used in these devices, in particular the hoses provided at the outer diameter, are relatively susceptible to defects.

With a clamping device according to European Patent A 0 413 890 the sleeve is engaged with a supporting body by means of a number of axially and radially adjustable sliding elements, which rotates around its own axis, while the sliding elements in each case are placed in a guideway of a cylinder core, said guideway being developed as an inclined plane, which is movable by a piston/cylinder unit in the axial direction relative to the supporting body and, as a function of the direction of motion, in each case said sliding elements are adjusted radially toward the outside or inside together with a clamping element placed thereon.

In view of the foregoing, the present invention provides an improvement of devices for clamping a sleeve placed onto a tube for winding and/or unwinding a two-dimensional web in that, while maintaining a secure clamping, the structural design of the individual elements is considerably simplified and the clamping elements provided at the tube are easily accessible and, if required, can be replaced without incurring special expenditure.

SUMMARY OF THE INVENTION

The foregoing object is achieved in the present invention in that the inside space of the tube is developed as a self-contained pressure chamber to be charged with a gaseous medium, and the tube is provided with several clamping elements distributed both in the axial and in the circumferential direction, which are installed into the tube wall and are provided with one pressure element each which is pressurized by the internal pressure and can be moved radially toward the outside and engaged with the inside wall of the sleeve to be clamped, as well as be returned upon depressurization which releases the sleeve from the tube.

The present invention provides a device that is able to produce an even gripping power across the entire length of the tube which is developed as a support element, together with the individual clamping elements which are distributed along said tube. The assembly and disassembly of the individual clamping elements on the tube can be performed easily from the outside. Further, the tube, which is developed as a pressure chamber, can be filled and evacuated through the nozzles, without using additional, costly devices. The proposed device also allows standardization and thus cost-effective production of individual components.

The present invention provides a device that may be used with tubes having support bearings on both ends or on one end, and a pressure gage may also be provided at the tube so that the pressure inside the pressure chamber may be monitored.

Other characteristic features of the invention follow from the description as embodied in the drawings and the claims.

DETAILED DESCRIPTION OF THE INVENTION

The device according to the invention for clamping a sleeve for winding and/or unwinding a two-dimensional web comprises a tube having an inside space, an outside surface, an axial dimension along a longitudinal axis, a circumferential dimension, a tube wall, and several clamping elements installed in the tube wall. Each of the clamping elements has a clamping effect, and, due to the clamping effect of at least one of the clamping elements to be engaged, the sleeve is effectively connected with the tube and they are rotated and driven around the longitudinal axis. The inside space of the tube is developed as a self-contained pressure chamber to be charged with a pressurized medium, and the several clamping elements are distributed both in the axial direction and the circumferential direction of the tube. Each of the several clamping elements are provided with a thrust carrying piece which, by a force exerted by the pressurized medium, moves radially from a starting position toward the outside surface of the tube and engages with an inside wall of the sleeve to be clamped, and, when the force exerted by the pressurized medium is removed by depressurization, the thrust carrying piece is returned to the starting position, which releases the sleeve from the device.

As defined herein, the term engagement is defined as encompassing both positive engagement or non-positive engagement.

Figure 1:
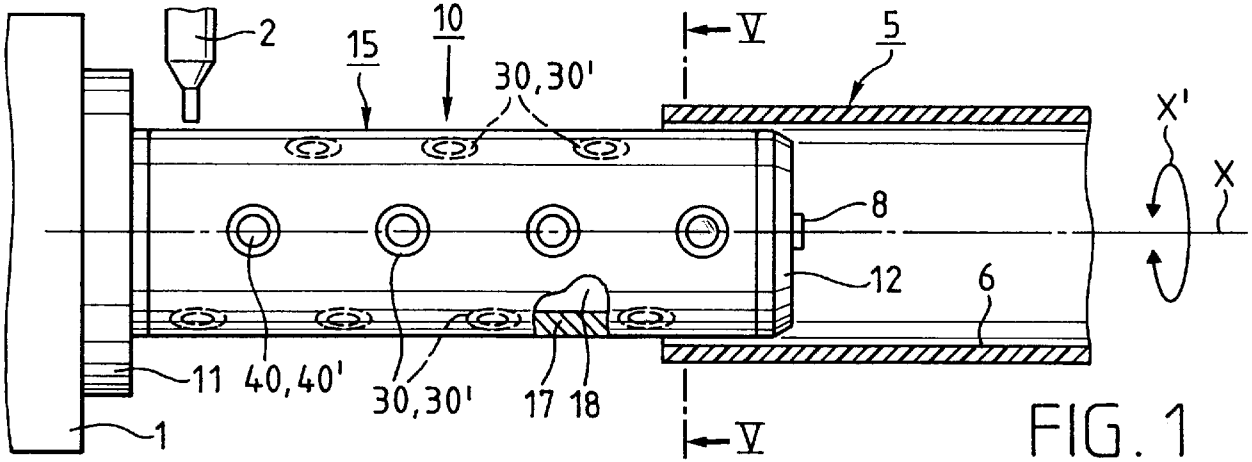
FIG. 1 shows a first embodiment of a section of a device according to the invention for clamping a sleeve.
Figure 2:
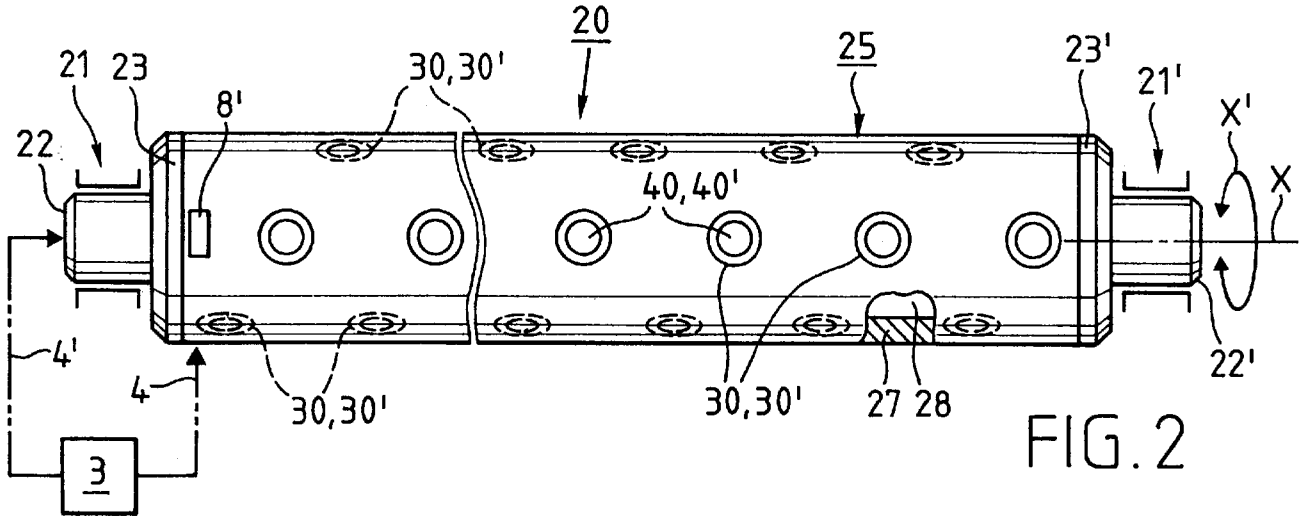
FIG. 2 shows a second embodiment of a section of a device according to the invention.

FIG. 1 shows a first embodiment of a device 10, and FIG. 2 shows a second embodiment of a device 20 for winding and/or unwinding two-dimensional materials in the form of webs made from paper, plastic, metal foil or similar material, onto a sleeve or from a sleeve. The first device 10 is developed as a mandrel run on bearings on one side, and the second device 20 is developed as a mandrel run on bearings on both sides. The two devices 10 and 20 are provided with clamping elements 30 or 30' which are set off against each other and developed in each case to accommodate a sleeve 5 which can be slid on in the axial direction, as shown in FIG. 1. The special development of the two devices 10 and 20, as well as the individual clamping elements 30 or 30' are described in detail in the following.

The first device 10 shown in FIG. 1 in a schematic diagram comprises a cylindrical hollow tube 15 which has installed at one end a first flange 12 acting as a seal, which is attached by a screw connection or any other suitable means for attachment. A second flange 11 is attached at the opposite end and also acts as a seal. The second flange 11 is attached to a schematically shown supporting element 1 of a driving or brake unit which is not shown in detail. By means of the driving or brake unit the device 10, together with the sleeve 5 which is clamped to the tube 15 by virtue of the clamping effect of the clamping elements 30 or 30', can be driven around a common horizontal longitudinal axis X in the direction of the arrow X', or slowed down.

FIG. 1 shows the tube 15 partially cut open and identifies the tube wall 17 and the inner wall 18 which, by means of the flanges 11 and 12 placed and attached at the ends of the tube 15, forms a self-contained pressure chamber. Further, the device 10 contains a number of clamping elements 30 or 30' which are set off against each other at the tube 15 both in the circumferential and the axial direction. The clamping elements 30 or 30' are provided in each case in a recess 16, as shown in FIG. 5. The recess 16 penetrates the tube wall 17 in the radial direction. The individual clamping elements 30 or 30' are installed in recess 16 and attached by suitable means to form a pressure seal, for example, press fitting or a threaded connection. The individual clamping elements 30 and 30' will be described in the following in connection with FIGS. 3, 4 and 6.

The inside space 18 of the tube 15 of the device 10, which at both ends is enclosed by the two flanges 11 and 12, essentially serves as a pressure chamber (reservoir) which, after the sleeve 5 has been slid on, is pressurized by means of a pressure source 2, as shown schematically in FIG. 1. Pressure source 2 may comprise, for example, a gaseous medium such as compressed air. The pressure of the gaseous medium may be on the order of magnitude of 6 bar. In order to connect the pressure source 2, the tube 15 is provided with a return valve (not shown), which for example, is screwed into the pipe wall 17, and can be actuated for relieving the pressure chamber and thus for releasing the sleeve 5, for example, without employing additional devices.

FIG. 2 shows a second embodiment of the device 20 presented in a section, which is comprised of a hollow cylindrical tube 25, as well as several clamping elements 30 or 30' which are set off against each other at said tube both in the circumferential and the axial direction. The tube 25 is shown partially cut open, identifying the tube wall 27 and the inside space 28. The second device 20 shown in FIG. 2 differs from the first device 10 shown in FIG. 1 in that in the second device 20 the tube 25 is enclosed at both ends by flanges 23 and 23', each acting as a seal. The flanges 23 and 23' are installed in any manner accomplishing said sealing, for example, by using a screw connection. At both flanges 23 and 23' are provided axles 22 and 22', respectively. The device 20 is supported by means of said axles 22 and 22' placed in schematically shown bearing units 21 and 21', respectively. The second device 20 also is effectively connected with a driving unit (not shown) by means of which the device 20 together with the sleeve (not shown), which essentially is held at the tube 25 by virtue of the clamping effect of the clamping elements 30 or 30', can be rotated and driven around a common horizontal longitudinal axis X in the direction of the arrow X'.

The inside space 28 of the tube 25 of the device 20, which at both ends is enclosed by the two flanges 23, 23', essentially serves as a pressure chamber (reservoir) which, after sliding on the sleeve (not shown), is pressurized by means of a pressure source 3 shown schematically in FIG. 2, for example, with a gaseous medium, but preferably with compressed air, said compressed air having an order of magnitude of 6 bar. In order to connect the pressure source 3, a return valve (not shown) which, for example, is screwed into the tube wall 27 or placed at the body of the axle 22, is provided at the tube 25. The return valve can be actuated for relieving the pressure chamber and thus for releasing the sleeve preferably without additional devices. In the return valve configuration at the body of the axle 22, said configuration is connected with the inside space 28 of the tube 25 via a channel system (not shown). With a stationary pressure source 3, said source can be connected with the body of the axle 22 via corresponding lines 4 or 4' at the tube 25 or at the channel system (not shown). One line 4' can, for example, be attached to the body of the axle 22, which attachment is not shown in detail.

Figure 3:
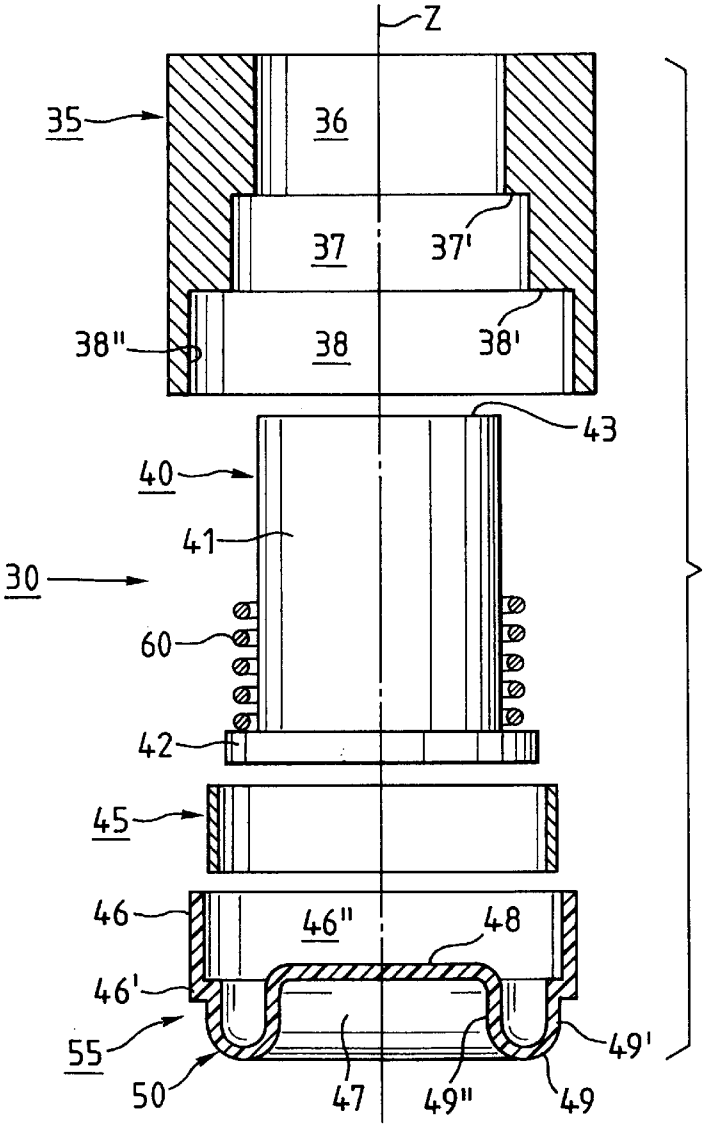
FIG. 3 shows an exploded view and a cross-section of the clamping element of a device according to FIG. 1 or FIG. 2.

As a first embodiment, FIG. 3 shows the clamping element 30 for the device 10 or 20 according to FIG. 1 or FIG. 2, respectively, said element being shown in an exploded view both in a section and in the longitudinal direction of the mid-axis Z. The clamping element 30 essentially comprises a housing 35, a thrust carrying piece 40, an inner sleeve 45, a diaphragm 55 and a pressure spring 60. The components of the clamping element 30 are described in detail in the following. The housing 35, which preferably is developed in the form of a cylinder, is penetrated by three cylindrical recesses 36, 37 and 38 which are stepped in diameter and run in the axial direction. The first recess 36 is developed to guide the thrust carrying piece 40, the second recess 37 is provided with an annular fitting edge 37' to accommodate the pressure spring 60 which is effectively connected with the thrust carrying piece, and the third recess 38 also is provided with an annular fitting edge 38' and a fitting edge 38" to accommodate the diaphragm 55. The thrust carrying piece 40 is provided with a guide 41 and an integrally molded flange 42 which is provided as a supporting surface for the pressure spring 60, which surrounds the guide 41 thrust carrying piece 40 in a circular manner. The guide 41 is preferably in the form of a cylinder. In order to provide a positive and non-positive surface at the inside 6 of the sleeve 5 (FIG. 5) to be clamped, the face designated as 43 of the guide 41 can optionally be provided with grooves (not shown).

The diaphragm 55, which is developed for the lifting motion of the thrust carrying piece 40, is provided with a seating 46" which is formed by an outer annular side wall 46 and provided with a recess 46', which serves to accommodate the inner sleeve 45 and is limited by a partition 48. At the outer side wall 46 another integrally molded U-shaped ring section 50 is placed in the profile cross-section, which has a curved section 49 and two walls 49' and 49" which are integrally molded at a distance at said curve section. The outer wall 49' of the U-shaped ring section 50 is integrally molded at the recess 46' of the outer side wall 46. The inner wall 49", which runs in the axial direction at a distance from the curved section 49 transverse to the outer side wall 46, is integrally molded at the partition 48 in such a way that the side opposite the first inside space 46" is provided with a chamber 47 which is so designed that it opens toward the outside.

Figure 4:
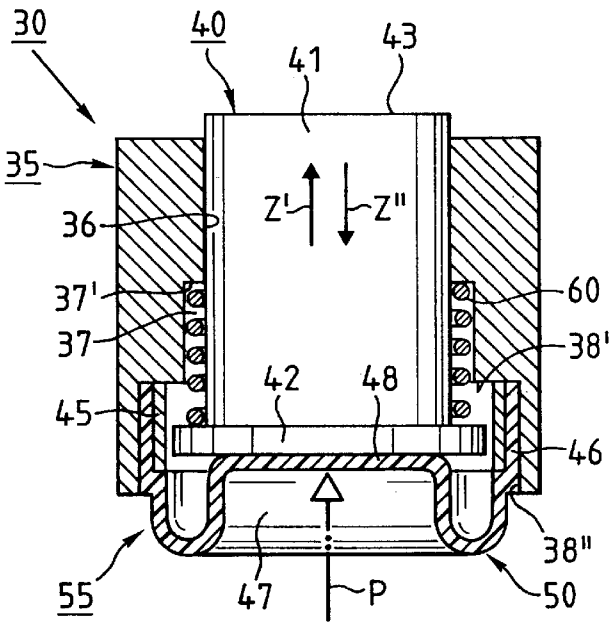
FIG. 4 shows an assembled clamping element according to the invention with a section of the clamping element shown in cross-section.
Figure 5:
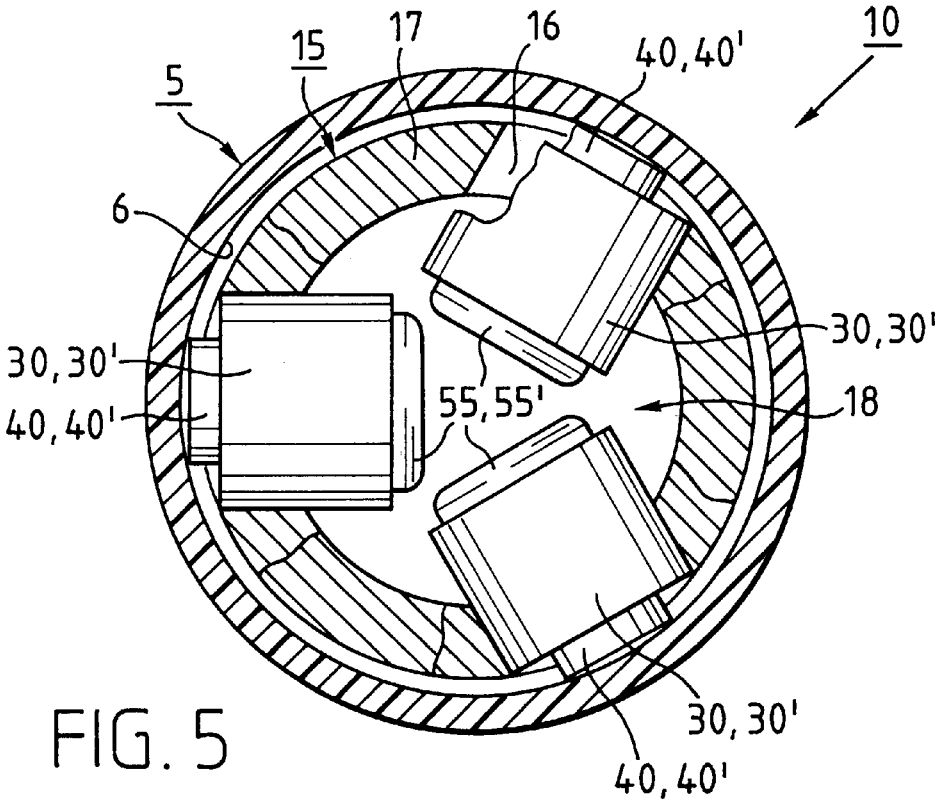
FIG. 5 shows a larger scale of a cross-section along lines V—V of FIG. 1.

FIG. 4 shows the clamping element 30 in an assembled state, with certain portions of the clamping element 30 shown in cross-section, thus identifying the housing 35, the thrust carrying piece 40 guided with the guide 41 in the first cylindrical recess 36, as well as the pressure spring 60 supported at the flange 42 of the thrust carrying piece 40 and at the annular fitting edge 37' of the second recess 37. The diaphragm 55 is placed at the side wall 46 in the third recess 38 and by means of the applied and correspondingly dimensioned inner sleeve 45 is pressed against the inner wall 38" and held in the housing 35.

During a corresponding pressurization, indicated by the pressurization arrow P, which pressurization is applied to the partition 48 of the diaphragm 55 in the direction indicated by the pressurization arrow P in FIG. 4, the thrust carrying piece 40 is moved toward the outside against the restoring force of the pressure spring 60 and in the direction of the arrow Z'. During a corresponding depressurization through the restoring force of the pressure spring 60 which acts in the direction of the arrow Z", the thrust carrying piece 40 moves in the direction of the restoring force of the pressure spring and returns to the starting position as shown in FIG. 4. The movement of the thrust carrying piece 40 in the axial direction Z' is stop-limited by the annular fitting edge 38' in the housing 35 being contacted by the flange 42.

The movement of the thrust carrying piece 40 outward in the radial direction so as to engage the inside wall of the sleeve either positively or non-positively, as described above, is facilitated by the pressurization of the pressure chamber having an adequate force to overcome the resistance of the thrust carrying piece to such movement. This resistance to movement may be provided by the diaphragm 55 or 55', the return spring 60, the friction between the guide 41 and the housing 35, or any combination of these sources of resistance to movement.

FIG. 5 shows the device 10 in a section along lines V—V of FIG. 1, as well as in a larger scale than FIG. 1, and it identifies the tube 15 with the bores 16 or threaded bores (not shown in FIG. 5) for the clamping elements 30 or 30' which penetrate the tube wall 17. In the embodiment shown in FIG. 5 are provided three clamping elements 30 or 30' distributed on the tube 15, which are so pressurized by the pressure of the inside space 18 that a thrust carrying piece 40 or 40', which is placed at each clamping element 30 or 30', is pushed radially toward the outside and against the inner wall 6 of the sleeve 5 to be clamped. The number of clamping elements 30 or 30' placed in the circumferential direction at the tube 15 essentially depends upon the diameter of the sleeve 5 to be clamped.

At this juncture it must be pointed out that either of the clamping elements 30 or 30' or a combination of them may be placed in either the tube 15 or the tube 25, and can be randomly placed in relation to each other in the axial direction and in the circumferential direction of the tube. In a preferred embodiment the clamping elements 30 or 30' are preferably placed in the tube 15 or 25 so that said elements are spaced in the axial direction so that in a cutting plane of each tube 15 or 25, which runs transverse to the longitudinal axis X, only one clamping element 30 or 30' is placed in said cutting plane, as shown in FIG. 1 and FIG. 2. As a result of this configuration of the required through-holes 16, the stability of the tube 15 is generally maintained.

Figure 6:
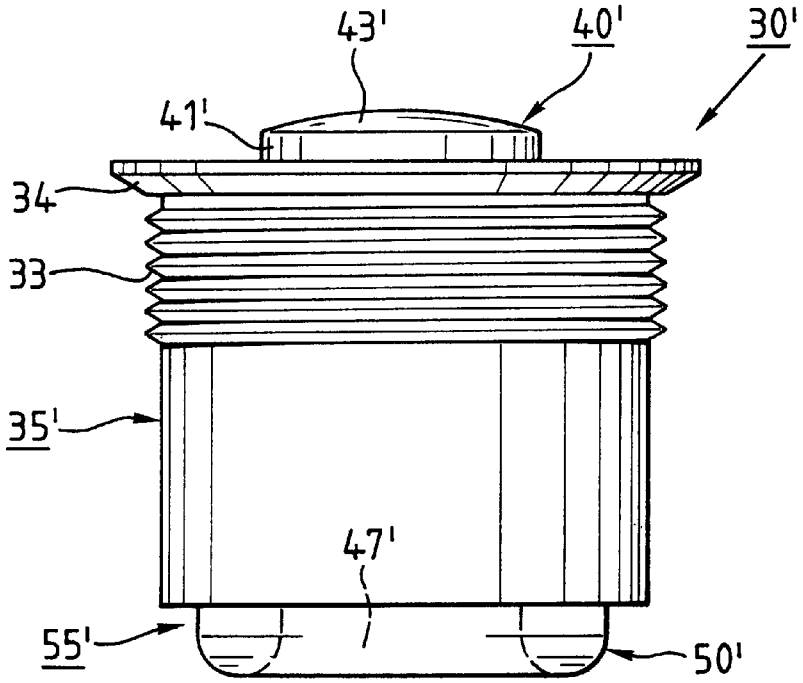
FIG. 6 shows a section of another embodiment of the clamping element according to the invention for the device according to FIG. 1 or FIG. 2.

FIG. 6 shows a second embodiment of the clamping element 30', presented in a schematic view, and identifies a housing designated as 35', the thrust carrying piece 40' which can be slid in the axial direction, and the diaphragm 55' with the U-shaped ring section 50', which is provided at the other end of the housing 35'. Deviating from the embodiment according to FIG. 4, in the embodiment shown in FIG. 6 the housing 35 is provided with an external thread 33 and a conical recess 34, so that said housing is sealed when screwing it into the tube wall 17 of tube 15 (FIG. 1) or tube wall 27 of tube 25 (FIG. 2). In this embodiment of the invention, through holes 16 are provided with an internal thread corresponding to external thread 33 of housing 35. The conical recess 34 is so developed that it effects an optimal sealing of the clamping element 30' which is screwed into the tube 15 or 25. Through holes 16 may also be provided with a conical opening corresponding to conical recess 34, to facilitate sealing. With another embodiment, the guide 41' of the thrust carrying piece 40', at the end of the sleeve 5 (FIG. 5) projecting from the housing 35' can be provided with a ellipsoidal-shaped face 43', in order to provide a better seating, as well as a positive and non-positive connection with the inner wall 6.

The diaphragm 55 or 55' provided at the housing 35 or 35' of the clamping elements 30 or 30' is preferably made from an elastic ductile material, for example, hard rubber, plastic or similar material.

The existing or required pressure within the pressure chamber 18 or 28 is preferably indicated by a pressure gage 8 or 8' which is placed and attached in an easily visible location on the tube 15 or 25. In the first embodiment shown in FIG. 1 the pressure gage 8 can be provided, for example, at the face of the flange 12 and with the second embodiment shown in FIG. 2 the pressure gage 8' can be provided, for example, at the free end of the tube 25.

The above described clamping elements 30 or 30' are preferably pressed or screwed into the tube wall 17 or 27 of the tube 15 or 25, so as to produce a pressure seal.

The invention is not limited to the above described embodiments, so that other advantageous embodiments are possible, without deviating from the basic concept, in particular, however, the development and use of the tube 15 or 25 which is provided as pressure reservoir and supporting element, as well as the configuration and development of the individual clamping elements 30 or 30'.

What is claimed is:

1. A device for clamping a sleeve for winding and unwinding a two-dimensional web, said device comprising a tube having an inside space, an outside surface, an axial dimension along a longitudinal axis, a circumferential dimension, a tube wall, several clamping elements installed in said tube wall wherein each of said clamping elements has a clamping effect; and, due to the clamping effect of at least one of the clamping elements to be engaged, said sleeve is effectively connected with the tube and they are rotated and driven around said longitudinal axis, wherein the inside space of the tube is developed as a self-contained pressure chamber to be charged with a pressurized medium, said several clamping elements are distributed both in the axial direction and the circumferential direction of the tube, wherein each of said several clamping elements comprise a housing and is provided with a thrust carrying piece; said thrust carrying piece comprises a face and can be moved in said housing against a pressure spring having a restoring force, said pressure spring contacting said housing and said thrust carrying piece and wherein said thrust carrying piece is effectively connected with a diaphragm which projects into the inside space of the tube, said diaphragm provided with a ring section which has a U-shaped curved section between an inner and an outer circular wall and, extending from the inner wall of said ring section is integrally molded a partition transverse to and at a distance from the curved section, and a circular side wall which integrally molded to and extends from the outer wall, said diaphragm being held in a recess of the housing in such a way that, under adequate pressurization by the pressurized medium, said thrust carrying piece slides radially with respect to the longitudinal axis of the tube from a starting position toward the outside of the tube, and wherein said face engages with said inside wall of the sleeve to be clamped so that said face and said inside wall of the sleeve are engaged non-positively and, when the force exerted by the pressurized medium is removed by depressurization, the thrust carrying piece is returned to the starting position which releases the sleeve.

2. The device as claimed in claim 1, wherein the clamping elements distributed at the tube are placed in the axial direction at a distance to each others that only one clamping element is placed in cutting plane of the tube transverse to the longitudinal axis in the circumferential direction.

3. The device as claimed in claim 1, wherein the clamping elements are placed in the tube wall at equal distances from each other both in the circumferential and in the axial direction.

4. The device as claimed in claim 1, wherein the clamping elements are placed in the tube wall by means of pressing or a screw connection which acts as a seal.

5. The device as claimed in claim 1, wherein the thrust carrying piece with a cylindrical guide is guided in the housing against the restoring force of the pressure spring and the diaphragm with respect to the longitudinal axis of the tube, and can be radially adjusted toward the outside, while being stop-limited, by means of the contact between a flange attached to the thrust carrying piece with a fitting edge provided in the housing, and be returned to the starting position.

6. The device as claimed in claim 1, wherein said face which provides contact with the inside wall of the sleeve to be clamped is provided with grooves or is elliptical.

7. The device as claimed in claim 1, wherein the diaphragm is held in the housing by means of an inner sleeve which presses the circular side wall of the diaphragm against the inner wall of the housing.

8. The device as claimed in claim 1, wherein said diaphragm is designed as a single unit and made from ductile material selected from the group consisting of had rubber and plastic.

9. The device as claimed in claim 1, wherein said self-contained pressure chamber at the tube which is developed as pressure reservoir, comprises at least one pressure gage connected with the pressure chamber.

10. The device as claimed in claim 1, wherein said face which provides contact with the inside wall of the sleeve to be clamped is provided with grooves or is ellipsoidal.

* * * * *